United States Patent [19]

Björlund

[11] Patent Number: 4,564,309

[45] Date of Patent: Jan. 14, 1986

[54] POST, SUCH AS A ROADSIDE MARKING POST, A TRAFFIC SIGN POST OR A LAMP POST

[76] Inventor: John Björlund, Cederbourgsgatan 6, Göteborg, Sweden, 412 55

[21] Appl. No.: 517,530

[22] PCT Filed: Nov. 25, 1982

[86] PCT No.: PCT/SE82/00398

§ 371 Date: Jul. 14, 1983

§ 102(e) Date: Jul. 14, 1983

[87] PCT Pub. No.: WO83/01972

PCT Pub. Date: Jun. 9, 1983

[30] Foreign Application Priority Data

Nov. 27, 1981 [SE] Sweden ..... 8107081

[51] Int. Cl.[4] ..... E01F 9/01

[52] U.S. Cl. ..... 404/10; 40/608; 264/146; 264/150; 72/367; 493/288; 493/293; 493/339

[58] Field of Search ..... 404/6, 9–11; 264/146, 150, 157, 159, 154; 40/608, 612; 116/63 R, 63 P; 428/36; 493/287, 288, 293, 339; 72/254, 367

[56] References Cited

U.S. PATENT DOCUMENTS

| | | | |
|---|---|---|---|
| 1,599,066 | 9/1926 | Rushmore | 40/608 |
| 1,754,771 | 4/1930 | Kirschbraun | 428/36 X |
| 2,121,961 | 6/1938 | Gill | 404/10 |
| 2,848,747 | 8/1958 | Dixon | 264/146 |
| 3,553,303 | 12/1967 | Zavasnik | 264/150 |
| 4,036,666 | 7/1977 | Mlavsky | 264/146 X |
| 4,084,914 | 4/1978 | Humphrey et al. | 40/608 X |
| 4,092,081 | 5/1978 | Schmanski | 404/10 |
| 4,245,922 | 1/1981 | Auriemma | 404/10 |

FOREIGN PATENT DOCUMENTS

| | | | |
|---|---|---|---|
| 2420415 | 11/1979 | France | 264/157 |
| 622168 | 6/1961 | Italy | 116/63 P |
| 427658 | 4/1935 | United Kingdom | 40/608 |
| 2076877 | 12/1981 | United Kingdom | 404/6 |

*Primary Examiner*—James A. Leppink
*Assistant Examiner*—Beverly E. Hjorth
*Attorney, Agent, or Firm*—Holman & Stern

[57] ABSTRACT

A self-retaining post of a plastic material, such as PVC, for use as a roadside marking post, a traffic sign post, a lamp post, or for other comparable uses in road traffic environments, has a channel-shaped bending zone with substantially arcuate cross-section and with the convex side facing the on-coming traffic. The cross-sectional area of the bending zone increases progressively towards the lower end, whereby the flaring-out zone formed upon bending of the post will be larger below than above the line of bending. The greater inherent resiliency of the material below than above the line of bending will cause the post to bend back into an upright position after having been hit by a vehicle. Certain embodiments of the posts are manufactured by diagonally splitting lengths of extrusion-molded plastic tubing, forming two identically shaped posts from each tube length.

16 Claims, 12 Drawing Figures

FIG. 3
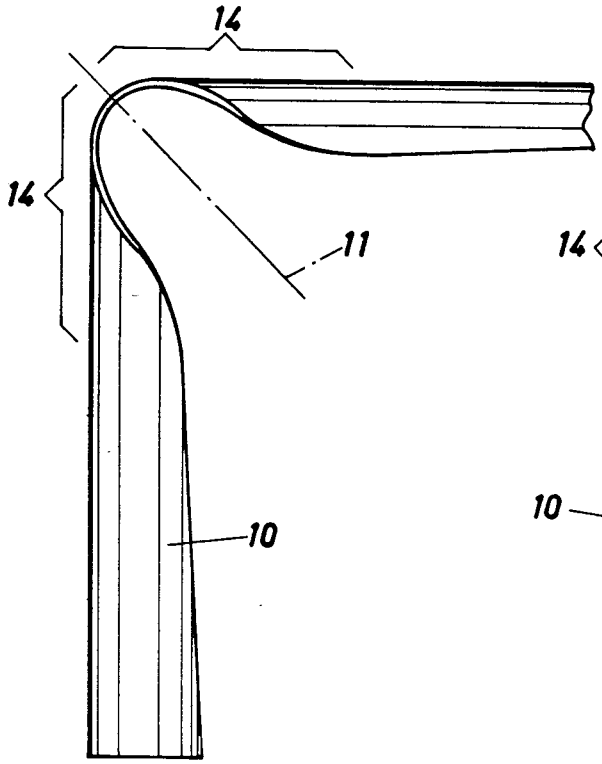
FIG. 4
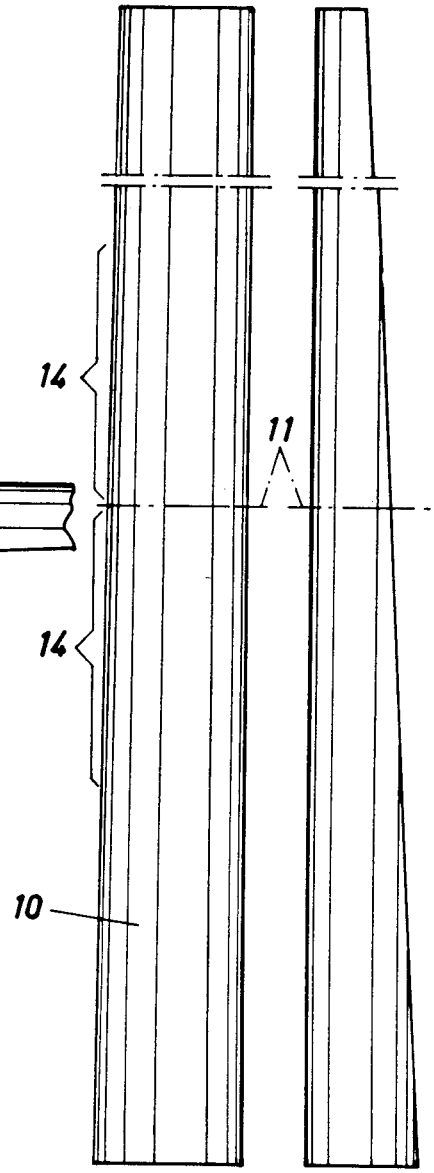
FIG. 5
FIG. 6
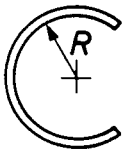
FIG. 7
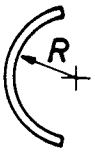

POST, SUCH AS A ROADSIDE MARKING POST, A TRAFFIC SIGN POST OR A LAMP POST

The invention of this application is disclosed in International Application No. PCT/SE82/00398, filed Nov. 25, 1982, under which priority is claimed under 35 USC 119.

BACKGROUND OF THE INVENTION

1. Field of the Invention

The present invention relates to a post for use as a roadside marking post, a traffic sign post, a lamp post, or for other comparable applications in a road traffic environment, and of the kind which is self-raising after having been hit by a vehicle. More specifically, the invention relates to posts of these kind which are made from a channel-shaped plastic profile, the channel-shaped side of which is facing away from the traffic, and which has, at least along its bending zone, a substantially arcuate cross-section.

2. Description of the Prior Art

Self-raising posts of the above kind are known from the U.S. Pat. No. 4,084,914. Posts according to that publication are in the form of a plastic profile which is substantially U-shaped, that is, it consists of two side portions and a flat middle portion therebetween. Unless the angle between the side portions and the middle portion is very obtuse, a bending of a post of this type will cause the material in the side portions to be folded as illustrated in the appended FIG. 1, causing material fatigue which might cause the material to break. It has been suggested, in order to reduce these concentrations of tension in the bending line area of the post, to make the post with an arcuate cross-section. In order to obtain a sufficient strength in the longitudinal direction, this known post is provided, at the channel-shaped innerside, with a reinforcement profile connected to the post by means of rivets or the like.

It has been found that a post of this type will not be self-raising if subjected to a bending of approximately 90°, since the upper, bent-around portion of the post is too long and too heavy to allow the springyness of the material to raise the post back up.

Another disadvantage with the known post is that in order for it to resist the stresses it might be subjected to it has to be made from a comparatively expensive plastic material, namely polycarbonate, which has good strength properties but requires a considerable thickness of the material. Furthermore, this material causes great wear on the extrusion moulding tools used for manufacturing the posts.

BRIEF SUMMARY OF THE INVENTION

The object of the present invention is to provide a post of the kind set forth above, which will have the property of self-raising, even if the post should be bent more than 90° and even if this occurs several times along the same line of folding. It is a further object of the invention to provide a post of this type which may be manufactured from an inexpensive plastics material, for instance PVC, without imparing the strength of the post. These and other objects have been attained by making the cross-sectional area of the post progressively increasing towards the lower end, whereby the flaring-out zone formed upon bending of the post will be larger, and thus the inherent resiliency of the material will be greater, below than above the folding line.

The invention also relates to a method of manufacturing posts of this kind. The method is mainly characterized in that a tube of a PVC-based impact resistant plastics material is formed by extrusion, that the extruded tube is cut into lengths corresponding to the length of the posts to be manufactured, and that the tube lengths are split along at least one diagonal line which is either straight or composed of several line parts.

BRIEF DESCRIPTION OF THE DRAWINGS

The invention will now be described in detail with reference to the accompanying drawings wherein:

FIG. 3 is a partial side view of the post shown in FIG. 2;

FIG. 4 is a front elevational view of the post of FIG. 3 shown upright;

FIG. 5 is a side view of the post shown in FIG. 4;

FIG. 6 is a cross-sectional view of the post of the invention taken at the lower end;

FIG. 7 is a cross-sectional view of the post of the invention taken at its upper end;

DETAILED DESCRIPTION

Figure 1:
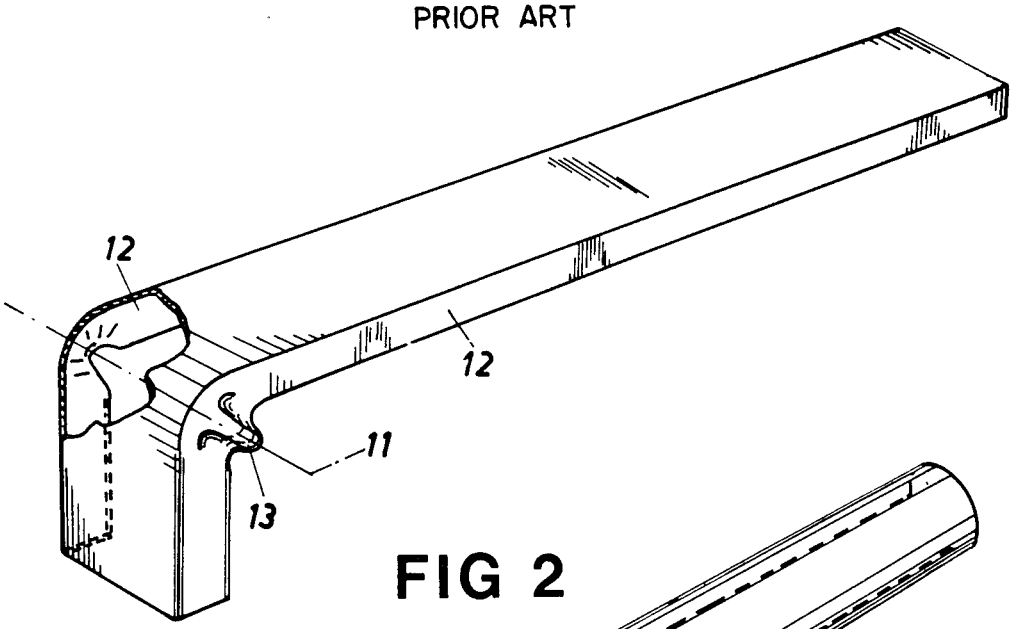
FIG 1 PRIOR ART
FIG. 1 is a view in perspective of a previously known post of the type which has been referred to in the introductory part of this specification, the post being shown in a bent condition.
Figure 2:
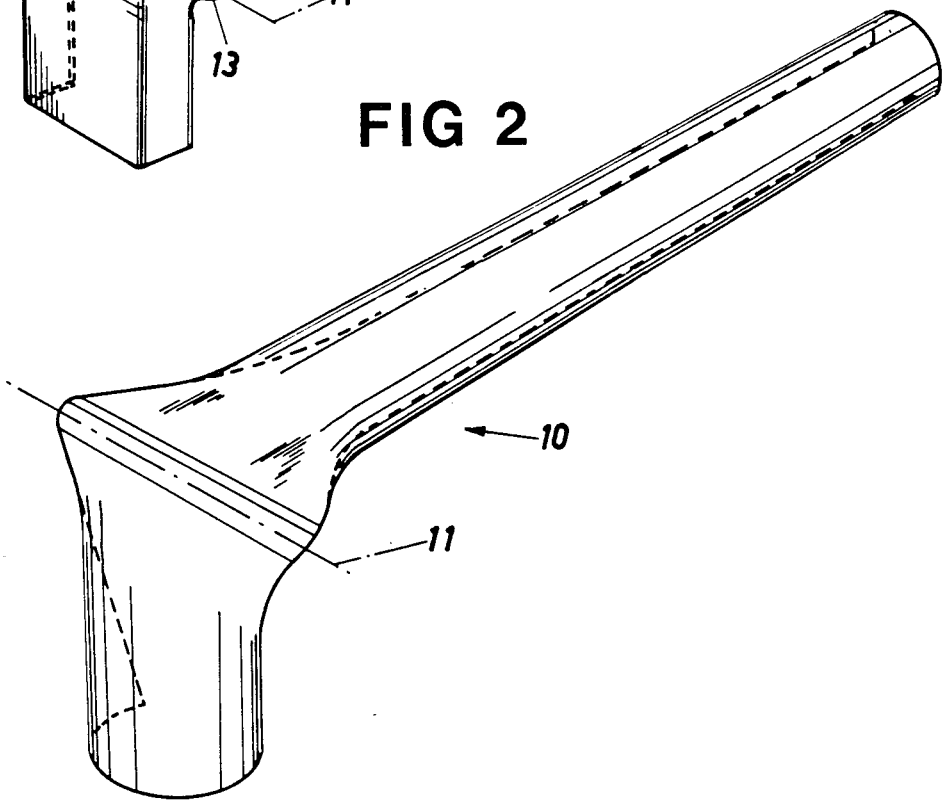
FIG. 2 is a view similar to FIG. 1 of a post according to the invention, also shown in a condition bent around at an angle of approximately 90°.

When a known post of the type illustrated in FIG. 1 which has substantially U-shaped cross-section is subjected to a sharp bending along the folding line 11, a severe concentration of tension will occur in the side portions 12 of the post. These stresses lead to the formation of a fold 13 in the folding zone. Tests have shown that these folded portions do not resume a flat condition when the bending force is removed from the post. If a vehicle runs into a post of this type, the post will be bent at a point situated about 30–40 cm above the ground. In other words, about $\frac{3}{4}$ of the length of the post will be bent around which means that, in order to be self-raising, the post must have an inherent resistance to bending greater than the counter force presented by the bent-around portion of the post. If the weight of the bent-around portion is greater than the resilient force of the material the post will remain in its bent-around condition. Furthermore, the remaining deformation in the folds 13 will cause material fatigue, further reducing the elasticity of the post.

According to the publication previously referred to, the post therein described is further provided with a reinforcing rail of arcuate cross-section, the concave sides of the post and the rail facing each other. Upon bending of such a composite post the rail has to be folded against the curvature of the arcuate profile, whereby the folding zone of the rail will be subjected to strong tensile stresses which may result in permanent deformations. Moreover, the rail further increases the weight of the post thereby further decreasing the ability of the post to raise itself after having been hit by a vehicle. It has also been proposed previously to make the post with an arcuate cross section, but with such a large radius, that the post has to be reinforced with a stiffening web in order to attain the necessary resistance to wind forces, whereby the post becomes such an "overweight" that it no longer is self-raising.

The post according to the invention utilizes the previously known, advantageous arcuate cross-sectional form, whereby the curved wall 10 of the post will be completely flattend along the folding line 11. In the drawings (FIG. 3) the transition from the arcuate cross-section to the flat cross-section is indicated at 14, and this transitional portion will hereinafter be termed the flaring-out zone. The desired self-raising ability of the post has now been attained in that the post, which has a substantially arcuate cross-sectional form, is made with its cross-sectional area increasing towards the lower end of the post. This will have the effect that the flaring-out zone of the post will always be larger below the folding line 11 than above the folding line, whereby also the surface area that has to be bent flat below the folding line is larger than the area above the folding line. Thus, the resilient forces acting on opposite sides of the folding line 11 are unbalanced, and this in itself very simple design feature provides a simple and reliable post with very good self-raising abilities, which means that the post is capable of being bent several times without the occurence of material fatigue.

In the embodiment illustrated in FIGS. 2–7 the post is made with the same radius of curvature at least along the whole of its bending zone, i.e. that portion of the post which will be subjected to bending when, for instance, the post is hit by a car. At its lower end, within the bending zone, the post preferably has a cross-section comprising at least one half of an arc of a circle, preferably about ¾ of an arc of a circle, which gives the post a very good stiffness in the lateral direction.

Figure 11:
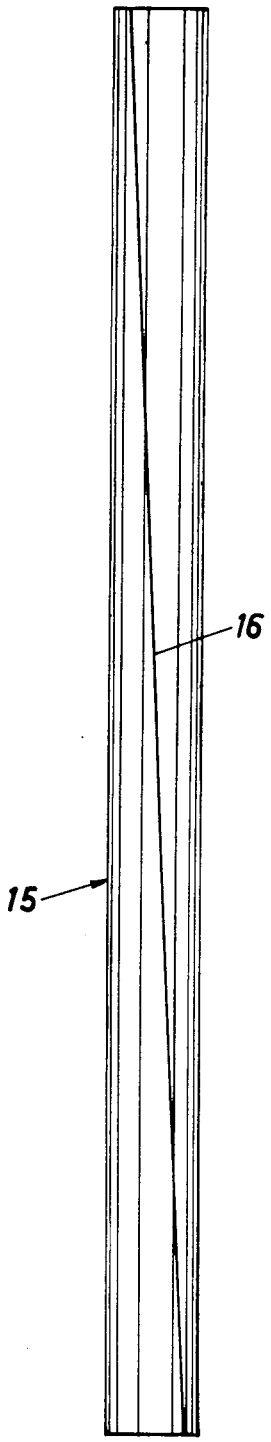
FIG. 11 is a side elevational view of a tube from which posts according to one embodiment of this invention are cut out.

The post is preferably manufactured from an extruded tube of a PVC-based, impact resistant plastics material, which is cut into lengths corresponding to the length of the post to be manufactured. These tube lengths are then split along a diagonal line 16 as shown in FIG. 11. In this way, two identical posts may be obtained from one length of the tube, and a further advantage is that the posts will be capable of being stacked for transportation into a much smaller volume than would be needed for tubular posts.

Figure 8:
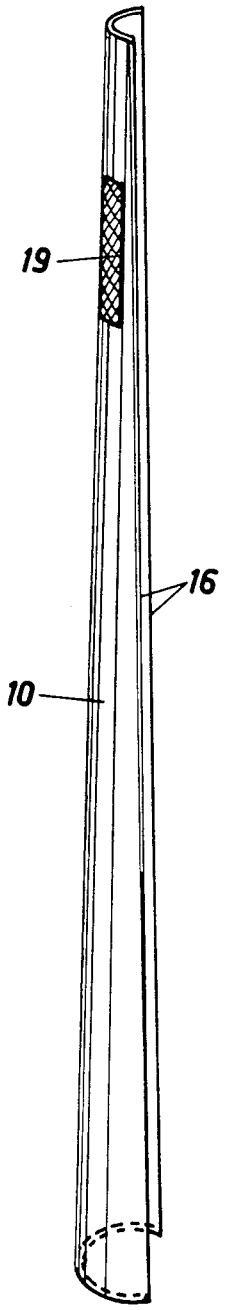
FIG. 8 is a perspective view of a conically formed post according to the invention.

In the modified embodiment illustrated in FIG. 8 the post has a conically tapering form with the radius of curvature progressively diminishing from the lower end towards the top end of the post.

Figure 9:
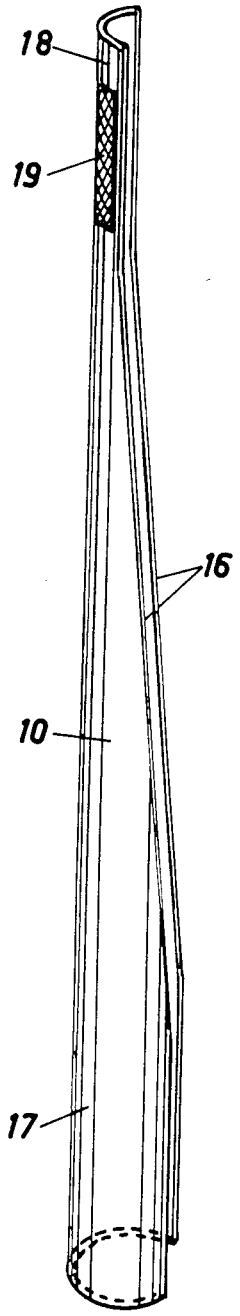
FIG. 9 is a perspective view of a further embodiment of the invention.

In certain cases it may be desirable to provide one or both end portions of the post with a portion having a constant cross-sectional area, as illustrated in FIG. 9, the lower portion 17 being used for anchoring the post in the ground, whereas the upper portion 18 is used for the attachment to the post of a reflecting device 19. This device may be of any known type, such as a piece of reflecting tape, or the type of device containing a reflector protected against weather conditions by means of an enclosed air cushion.

Figure 12:
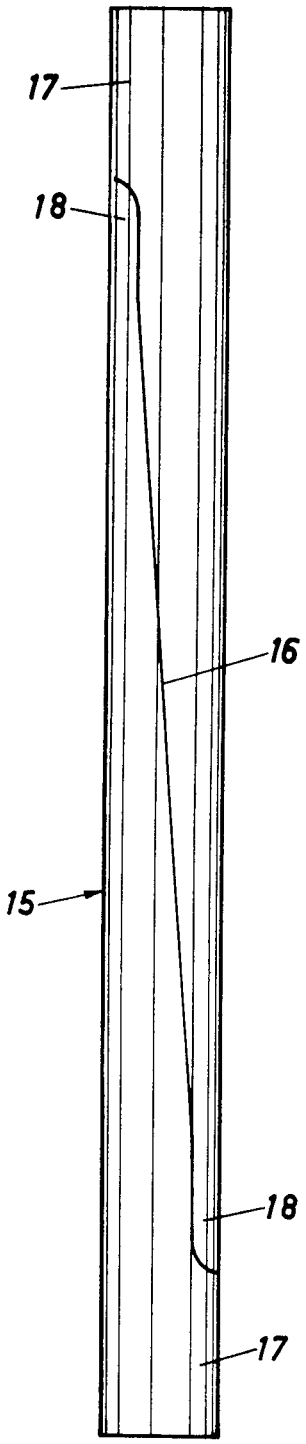
FIG. 12 is a view similar to FIG. 11 showing how posts according to another embodiment of the invention are cut out from a tube.

If the manner of anchoring the post to the ground necessitates that the lower portion of the post is made in the form of a closed tube, for instance when this tubular end portion is intended to be pushed over or into a steel tube driven into the ground, the embodiment illustrated in FIG. 12 would be applicable. In this embodiment as that illustrated in FIG. 11 two posts are made from one length of an extruded plastic tube by splitting the tube along a diagonal line 16, but in this case the diagonal line is composed of several line parts and does not extend to the ends of the length of the tube.

Figure 10:
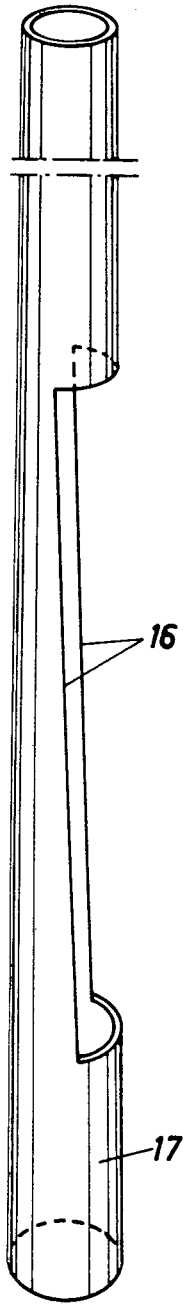
FIG. 10 is a view in perspective of an embodiment of the invention intended for use as a traffic sign post or a lamp post.

The embodiments so far described are mainly intended for use as roadside marking posts. In the case of lamp posts and traffic sign posts, which are considerably longer, the bending zone portion of the posts may be formed in the same way as previously described, i.e. with the cross-sectional area increasing towards the lower end, as illustrated in FIG. 10.

A post made in accordance with the invention also has the advantage of having a high resistance to swaying or "flittering" under the influence of high winds or the draught caused by passing vehicles, due to the downwardly increasing cross-sectional area of the post. The progressively increasing cross section also provides for good anchoring properties.

The invention is not limited to the embodiments shown, but may be modified within the scope of the appended claims.

I claim:

1. In a post, such as a roadside marking post, a traffic sign post or a lamp post, of the kind which is self-raising after having been hit by a vehicle and is made from a channel-shaped plastic material profile, the channel-shaped side of which faces away from the direction of impact in use, and which has an upper and a lower end, bending zone and a substantially arcuate cross-section at least along the bending zone, the improvement comprising:

the cross-sectional area of the post has a configuration that increases progressively towards the lower end, so that upon bending the post away from the direction of impact a flared-out portion is formed having a folding line and the flared-out portion is larger below said folding line than above said folding line, and thus the inherent resiliency of the material is greater below than above the folding line.

2. A post as claimed in claim 1 wherein the post has a part circular cross-section, at least within the bending zone, which has the same radius of curvature along the entire length thereof.

3. A post as claimed in claim 2 wherein at least the lower end portion of the post is tubular and has a circular cross-section.

4. A post as claimed in claim 3 wherein at least the upper end portion of the post has a uniform cross-section.

5. A post as claimed in claim 4 wherein the lower part of the post, within the bending zone, has a cross-section comprising at least ½ of an arc of a circle.

6. A post as claimed in claim 1, wherein at least the lower end portion of the post is tubular and has a circular cross-section.

7. A post as claimed in claim 1, wherein at least the upper end portion of the post has a uniform cross-section.

8. A post as claimed in claim 7 wherein the post, at least within its bending zone, has a conical shape with an increasing radius in the direction towards the lower end of the post.

9. A post as claimed in claim 1, wherein the lower part of the post, within the bending zone, has a cross-section comprising at least ½ of an arc of a circle.

10. A post as claimed in claim 9 wherein said cross-section of the lower part of the post comprises substantially ¾ of an arc of a circle.

11. A post as claimed in claim 9 wherein the post, at least within its bending zone, has a conical shape with an increasing radius in the direction towards the lower end of the post.

12. A post as claimed in claim 1, wherein the post, at least within its bending zone, has a conical shape with an increasing radius in the direction towards the lower end of the post.

13. A post as claimed in claim 1 made by the method comprising:

extruding a tube of resilient impact resistant plastic material;

cutting said tube into lengths corresponding to the desired length of the posts to be produced; and splitting said tube lengths along at least one diagonal straight line.

14. The method as claimed in claim 13 wherein said splitting step comprises splitting said tube diagonally along a plurality of line parts.

15. The method as claimed in claim 14 wherein said splitting of each tube length produces two identically shaped posts.

16. The method as claimed in claim 13 wherein said splitting of each tube length produces two identically shaped posts.

* * * * *